US009936839B1

(12) United States Patent
Richardson et al.

(10) Patent No.: US 9,936,839 B1
(45) Date of Patent: Apr. 10, 2018

(54) BILATERALLY COLLAPSIBLE BATHING RECEPTACLE

(71) Applicant: Puj, LLC, Vancouver, WA (US)

(72) Inventors: Benjamin Todd Richardson, Vancouver, WA (US); Kathryn A. Richardson, Vancouver, WA (US)

(73) Assignee: PUJ, LLC, Vancouver, WA (US)

( * ) Notice: Subject to any disclaimer, the term of this patent is extended or adjusted under 35 U.S.C. 154(b) by 0 days.

(21) Appl. No.: 14/925,925

(22) Filed: Oct. 28, 2015

Related U.S. Application Data

(63) Continuation-in-part of application No. 13/548,683, filed on Jul. 13, 2012, now abandoned, which is a continuation-in-part of application No. 12/004,904, filed on Dec. 21, 2007, now Pat. No. 8,250,683, and a continuation-in-part of application No. 12/229,827, filed on Aug. 26, 2008, now Pat. No. 8,250,684, which is a continuation-in-part of application No. 12/004,904, filed on Dec. 21, 2007, now Pat. No. 8,250,683.

(51) Int. Cl.
*A47K 3/06* (2006.01)

(52) U.S. Cl.
CPC ..... *A47K 3/06* (2013.01)

(58) Field of Classification Search
USPC ..... 4/572.1, 571.1, 578.1, 586, 587, 581; 297/53, 44, 16.2
See application file for complete search history.

(56) References Cited

U.S. PATENT DOCUMENTS

2007/0022526 A1* 2/2007 Leach ..... A47K 3/127 4/572.1
2012/0278988 A1* 11/2012 Richardson ..... A47K 3/064 4/586

* cited by examiner

*Primary Examiner* — Lauren Crane
(74) *Attorney, Agent, or Firm* — Paul B. Heynssens; Ater Wynne LLP

(57) ABSTRACT

A bilaterally collapsible bathing receptacle, includes a contiguous expanse of a resilient plastic material having a first concavely curved surface and an opposing convexly curved surface; and a first hinge extending from a first end to an opposing second end of the expanse, wherein the first hinge longitudinally bisects the expanse and defines opposing longitudinal bilateral halves thereof, and the expanse is configured to assume an open, bowl-like configuration in a relaxed state, and when inwardly compressed laterally, flexes along the first hinge and places the respective first surfaces of the opposing bilateral halves into confrontation with one another. The expanse may possess a generally uniform thickness throughout excepting the first hinge. The first surface of the expanse may be less concavely curved at a central region aligned with the first hinge than at a lateral region lying outwardly relative to the central region.

11 Claims, 3 Drawing Sheets

BILATERALLY COLLAPSIBLE BATHING RECEPTACLE

RELATED APPLICATIONS

This application is a Continuation-in-Part of and claims the benefit of priority to U.S. Non-Provisional application Ser. No. 13/548,683 filed on Jul. 13, 2012 and entitled BILATERALLY COLLAPSIBLE BATHING RECEPTACLE, and is further a Continuation-in-Part of and claims the benefit of priority to U.S. Non-Provisional application Ser. No. 12/004,904 filed on Dec. 21, 2007 and entitled BABY BATH SINK INSERT, and further is a Continuation-in-Part of and claims the benefit of priority to U.S. Non-Provisional application Ser. No. 12/229,827 filed on Aug. 26, 2008 and entitled BABY BATH SINK INSERT, which itself is a Continuation-in-Part of and claims the benefit of priority to said application Ser. No. 12/004,904, the contents of each of which are hereby incorporated herein in their entirety by this reference.

FIELD OF THE INVENTION

The invention relates generally to the field of bathing products for infants, and more particularly relates to bathing receptacles for infants and very small children.

BACKGROUND

Bathing babies is a basic care activity which presents numerous challenges to a parent or other caregiver. The choice of a bathing apparatus can mitigate some of these challenges. For example, a baby must be securely yet gently supported throughout bathing. Particularly the baby's head must be supported during the months prior to the baby acquiring capability for self-support. Typically this requires that the caregiver maintain an arm around the baby, leaving only one hand free to wash the baby. However, it can be difficult to simultaneously lift limbs and/or separate folds and to also scrub therein, under, or between.

Additionally, while many caregivers bathe babies in a washbasin (e.g., bathroom sink), washbasins typically comprise hard, cold, uncomfortable and unyielding surfaces which can be quite slippery when wet, presenting risks to a baby, not the least of which include accidental submersion, bruising, etc.

Numerous molded plastic bathtubs are available which include interior shapes configured to support a baby to some extent. However, such tubs are almost invariably relatively large and difficult to store when not in use, consuming substantial space and not having a size or shape configured to fit standard shelves, cabinet spaces, or other standard storage locations. Likewise, many such baby bathtubs comprise rigid materials that are slippery when wet, requiring a caregiver to support a baby with one hand throughout bathing. Additionally, many of the baby bathtubs advertised as 'baby sink baths' don't fit in a sink, and rather must be placed on a sink and/or adjacent countertop.

At least one collapsible miniature bathtub exists for bathing children, and is configured to hang within a standard bathtub, as described in U.S. Pat. No. 5,809,588. However, this collapsible tub still requires a caregiver to manually support the child during bathing, and also requires the caregiver to bend over and/or lift a baby from the tub at an awkward angle, which presents risks for musculoskeletal injuries to the caregiver.

BRIEF DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe a bathing receptacle. Although the present examples are described and illustrated herein as being implemented in a bathing receptacle system, the system described is provided as an example and not a limitation. As those skilled in the art will appreciate, the present examples are suitable for application in a variety of different types of bathing receptacle systems.

The present invention expands upon the concepts of a collapsible baby bathing apparatus first introduced by the applicants in U.S. Non-Provisional application Ser. No. 12/004,904 and 12/229,827, the disclosures of each of which are fully incorporated herein by reference. However, whereas the novel bathing apparatus example disclosed in those applications collapse outwardly to form a relatively planar material expanse, the invented examples introduced and described herein are configured to collapse inwardly, forming a stowable configuration having a reduced footprint when deployed for use.

Figure 1:
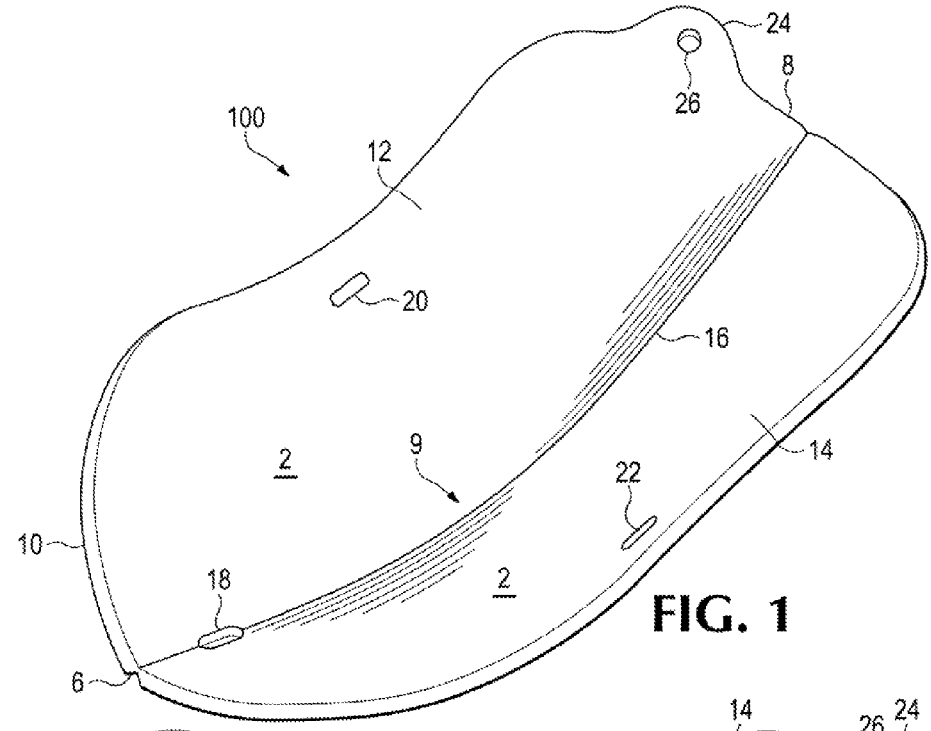
FIG. 1 is an isometric view depicting a collapsible bathing receptacle according to an embodiment of the invention.

Referring to example shown in FIG. 1, the invented apparatus generally comprises a contiguous expanse of a resilient, pliable material configured to assume an open, bowl-like configuration when in a relaxed state. The expanse includes a first concavely curved surface 2, referred to for convenience herein as an 'inner' surface, and also includes an opposing, convexly curved 'outer' surface 4 which is not visible in FIG. 1, but can be easily seen in FIGS. 2 and 3, for example. The apparatus assumes such relaxed, open state when deployed for use, such as by placing the convex, outer surface downwardly into a washbasin (e.g., bathroom or kitchen sink, etc.) or other similar receptacle. Because of the concave inner shape of the material and its resilience, a soft watertight cavity is formed in a first position shown in FIG. 1, and the receptacle may be folded away in a substantially flat shape for storage. Since the unit is flexible and mechanical relief is provided along grove or hinge 6 when the two sides 12, 14 are pushed together, one or the other of the inner concave surfaces 12, 14 pops, or changes the direction of its concavity to convex, to rest against the opposing concave surface, making a neat and compact unit for storage until it is needed again.

The concave inner surface 2 of the apparatus itself forms a basin, suitable in many examples for retaining water or another liquid medium useful for cleansing an infant. In a typical but not exclusive example, when inverted with the convex outer surface 4 orientated upwardly, the apparatus resembles a relatively squashed cone having a substantially rounded apex 11. The portion of the concave inner surface of the apparatus corresponding to the 'apex' is referred to herein for descriptive convenience as the 'floor' 9 of the apparatus.

The apparatus is typically but not exclusively elongate from a first 'head' end 8 to a second 'foot' end 10. The designations 'head' end and 'foot' end are used for convenience herein, and represent the typical and intended orientation of a human infant disposed at the inner surface 2 during use, relative to the opposing ends of the apparatus. During use, a human infant will typically be positioned in the apparatus with his buttocks received in the floor. The infant's torso and head are typically held in an elevated condition relative to the floor, supported by the head end of the apparatus extending away from the floor. Likewise, the infant's legs and feet are held in an elevated condition relative to the floor, supported by the foot end of the apparatus. Such positioning and configuration tends to continuously urge the infant's buttocks toward the floor, thereby stabilizing the infant in place within the apparatus despite the infant's movements.

A length from the extreme head end to the floor of the apparatus is preferably somewhat longer than a corresponding length from the floor to the extreme foot end of the apparatus, recognizing that a human infant's upper body proportions are typically greater than those of his legs. However, the corresponding head and foot ends can extend for equal lengths from the floor on their respective sides thereof, and the scope of the invention contemplates at least one example wherein the foot end can extend longer from the floor than does the head end.

In a typical example, the expanse possesses a generally uniform thickness and is made from a single material throughout, although various portions of the expanse can be configured either thicker or thinner than others. Typically, a closed cell foam may be utilized. An ordinarily skilled artisan will recognize that providing thickened portions can enhance structural rigidity of the apparatus during use. For example, portions of an outer periphery of the apparatus can be formed as a thickened rim. Alternatively, providing thinned portions can improve flexibility of the apparatus, enhancing conformity to the configuration of a basin in which the apparatus may be used, or may alternatively simply enhance the manufacturability of the apparatus. For example, areas of either of the first inner, or interior surface 2 or the second outer, or exterior surface 4 can be recessed, reducing the overall amount of utilized material and improving dimensional consistency achieved through a molding process used to mass produce the apparatus.

Figure 4:
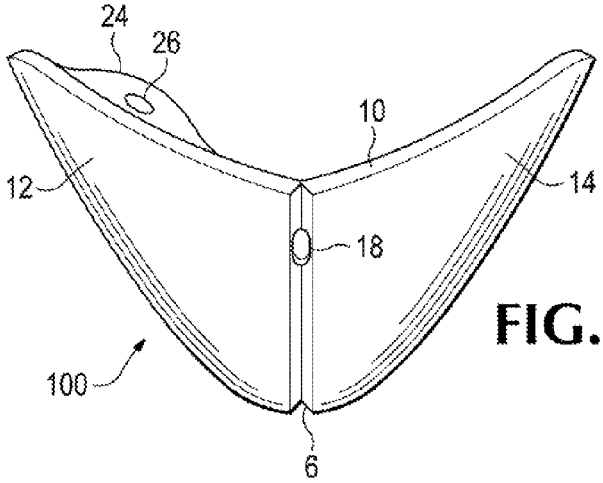
FIG. 4 is an end elevation view depicting the collapsible bathing receptacle of FIG. 1.
Figure 5:
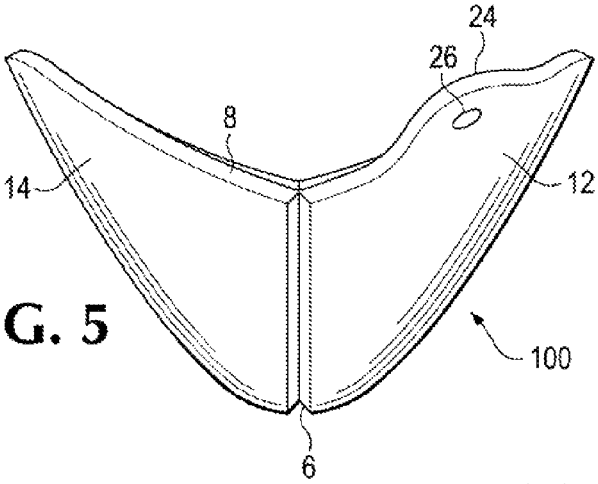
FIG. 5 is an opposing end elevation view relative to FIG. 4 depicting the collapsible bathing receptacle of FIG. 1.
Figure 9:
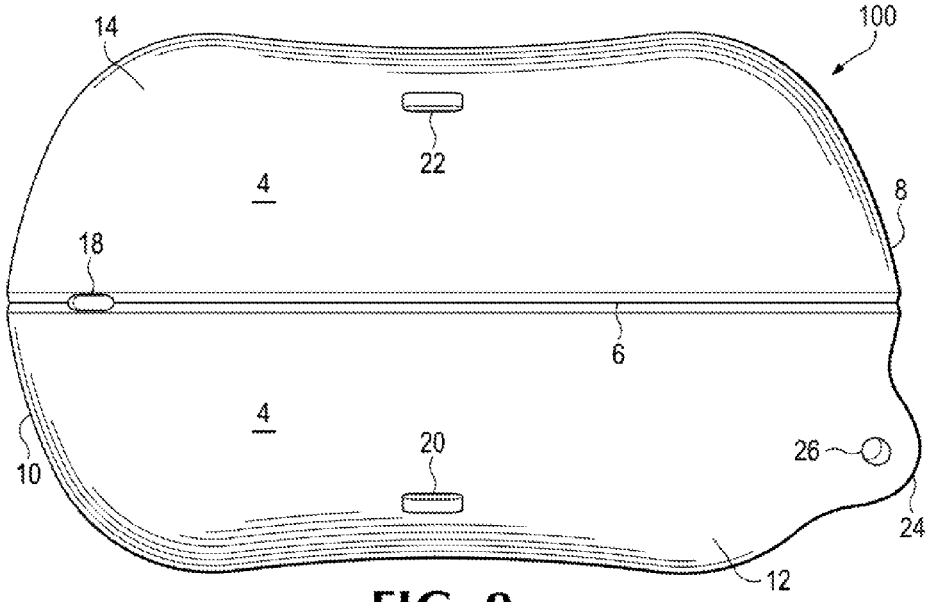
FIG. 9 is a bottom plan view of the collapsible bathing receptacle of FIG. 1.

A notable exception to the generally uniform thickness of the expanse, in a typical example, is a hinge 6 extending from the head end 8 to the opposing foot end 10 of the apparatus 100. The hinge or let out portion 6 in the material typically includes a linear groove formed into the second convex surface 4, although other examples are contemplated, as discussed in more detail below. The hinge 6, formed according to just such a linear groove example, is mainly hidden from sight in the view depicted in FIG. 1, but a terminal end of the hinge 6 can be seen to appear as a notch at the foot end 10 of the apparatus. Since the hinge is unitary with the first and second surfaces 12, 14 and is simply a let out area of the material, it maintains a water tight basin without the need for a separate piece to allow folding of the first and second surfaces. Portions of the hinge are more clearly visible in FIGS. 4 and 5, and the hinge is depicted throughout its entire length in FIG. 9. As shown, the hinge 6 typically bisects the expanse and defines opposing bilateral right 12 and left 14 halves thereof. The halves need not be bilaterally symmetrical —equivalent in size or shape relative to each other —but will be nearly so in a preferred example. At least one such bilaterally asymmetrical example is described herein.

A primary purpose of the hinge is to facilitate inward collapsibility of the apparatus. In particular, when the apparatus is inwardly compressed laterally, the expanse tends to flex along the entire length of the hinge, placing the respective first surfaces of the opposing bilateral halves into confrontation with one another. By flexing, the hinge allows either of the first 12 or second 14 surfaces to change its direction of concavity as it flexes and is pushed against the opposing surface. If the material was a simple flat sheet (which it is not) or resilient material with scoring to allow it to be folded into various shapes; clips, pins, or other fastening devices would have to be employed to change the shape of the sheet. Here the unique shape of the receptacle being formed in a bowl shape allows that shape to be changed and maintained without the need for clips, fasteners, or the like. The bowl shape in combination with the scoring (longitudinally flexible hinge) allows the receptacle to pop open or close through the action of the flexible material. The respective relaxed, open configuration, and the compressed, collapsed configuration, can be easily seen and understood by reference to the sectional views of FIGS. 6 and 7.

To facilitate flexibility of the apparatus 100 along its length, a grooved hinge may be configured as a recess extending through approximately half the thickness of the expanse. Alternatively, however, the groove can be formed through nearly any fraction of the thickness of the expanse, including one-quarter (¼), one-third (⅓), two-thirds (⅔), three-quarters (¾), or nearly any other fraction of the overall thickness of the expanse. Additionally, a remaining thickness of the expanse forming the grooved hinge can be found anywhere within the range of 0.5 to 40 millimeters, or preferentially within any sub-range found therein, according to one or more examples contemplated herein. Further, at least one example contemplates a remaining thickness of the expanse varying along the length of a grooved hinge, for example to provide varying degrees of flexibility at different portions of expanse to differentially encourage or restrain flexing of different portions of the expanse.

Because an expanse is typically substantially thinned along the length of a hinge configured as a groove, the expanse can be more susceptible to tearing along the groove. Therefore, the material of the expanse at a terminal end of a grooved hinge where the groove arrives at a periphery of the apparatus for example, can be thickened relative to the remainder of the groove to provide enhanced resistance to tearing along the groove initiating at the terminal end of the hinge. Such thickened portion will generally extend transversely across a hinge, spanning from one side of the groove to the other in a similar manner to a dam spanning a canyon. A thickened portion generally is not significantly thicker than the remainder of the expanse, and may typically be approximately the same thickness as the remainder of the expanse, but will in any case be thicker than the thinnest portion of the groove.

Similarly thickened groove portions can be provided, extending transversely across a grooved hinge, at one or more intervals along the length of a hinge, to help arrest and contain any tearing that may occur along the length of the hinge. Such thickened portions generally will not inhibit the hinge from freely flexing during manual collapse of the apparatus by a user, and an ordinarily skilled artisan can easily determine a preferred operable combination of length, thickness, position, and number of thickened portions to provide along a hinge in light of this description.

An effective groove 'depth' in any particular example can depend one or more factors, including the type of material from which the expanse is formed, the overall configuration of the hinge, the presence or absence of reinforcing structures, and others. Moreover, considerations affecting such selection include: (1) ease with which the hinge can be manually flexed; (2) resistance to tearing under reasonably expected tensile or shear loads that may be applied to a hinge during use; and (3) resistance to material fatigue and failure due to repeated flexing. An optimal hinge 6 in an example maximizes each of these three considerations.

Among other things, to demonstrate that the first hinge 6 may longitudinally bisect the expanse and define opposing longitudinal bilateral halves of the expanse 12/14, reference is made to groove 6, as shown in the several figures, and especially FIGS. 4-7. The groove 6 may be configured as a trench with angled side-walls (e.g., an inverted V-shape, such as ∧) formed along and into the outer surface of the apparatus. The angle between the opposing sidewalls of the groove can vary substantially in alternative examples from the approximately ninety degree (90°) angle perhaps most clearly shown in FIGS. 4 and 5, and can instead be either acute or obtuse when the apparatus is presented in an open, relaxed condition as in FIG. 1. In at least one contemplated example, the groove can instead resemble a slit, having relatively parallel opposing sidewalls when the apparatus assumes a relaxed condition as in FIG. 6, but the sidewalls depart from one another to form an angled trench (e.g., a ∧ shape) when the apparatus is bilaterally compressed as in FIG. 7.

As will be recognized by an ordinarily skilled artisan, collapsing the apparatus inwardly along the hinge will cause the inner, concave curvature of the apparatus to change, as the head and foot ends of the apparatus are forced apart from one another. Conversely, allowing the apparatus to resume a relaxed, open configuration results in the head and foot ends being drawn toward one another as the opposing bilateral halves of the apparatus bow outwardly.

In a preferred but non-exclusive example, the expanse is formed mainly or entirely of a closed-cell polymeric material. For example, the elastomeric polymer material ethylene-vinyl acetate (EVA), as described also in application Ser. No. 12/004,904, provides numerous beneficial properties to the bathing apparatus described herein, including tactile softness, compressibility, pliability, low thermal conductivity, suitable surface friction, stress-crack resistance, water resistance, and others. EVA can be either injection molded or compression molded to form the apparatus, for example, although the contemplated examples are not limited to any particular process of molding the apparatus. Additionally, the use of alternative materials is also contemplated, as is described further below.

As also described in application Ser. No. 12/004,904, examples of the invention described herein likewise include one or more perforations formed though the expanse from the first surface to the second surface. FIG. 1, for example, depicts one such perforation 18 disposed along a center line 16 near the foot end 10 of the apparatus 100, and two corresponding perforations 20/22 disposed in the opposing bilateral right 12 and left 14 halves of the apparatus. When the bathing apparatus is placed in a wash basin for use in a similar manner as depicted in application Ser. No. 12/004,904, the apparatus can retain water up to the level of whichever of the perforations is positioned lowest relative to the others. Any further water introduced into the concavity of the apparatus will then escape through the one or more perforations, enabling maintenance of a consistent water level therein despite the continued addition of water.

Figure 2:
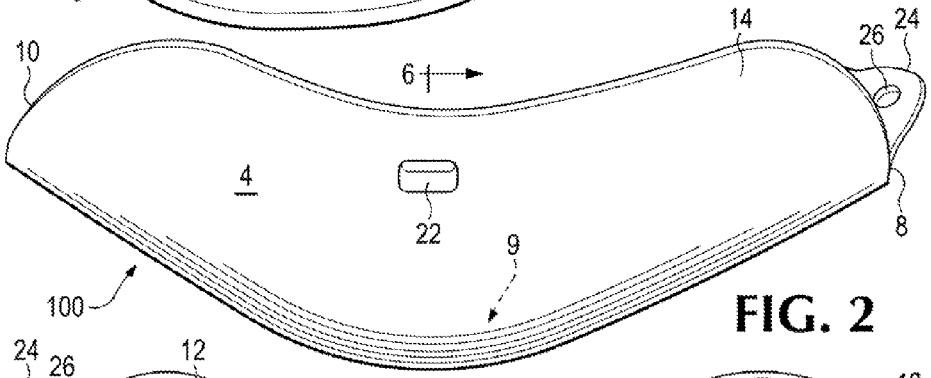
FIG. 2 is a side elevation view depicting the collapsible bathing receptacle of FIG. 1.
Figure 3:
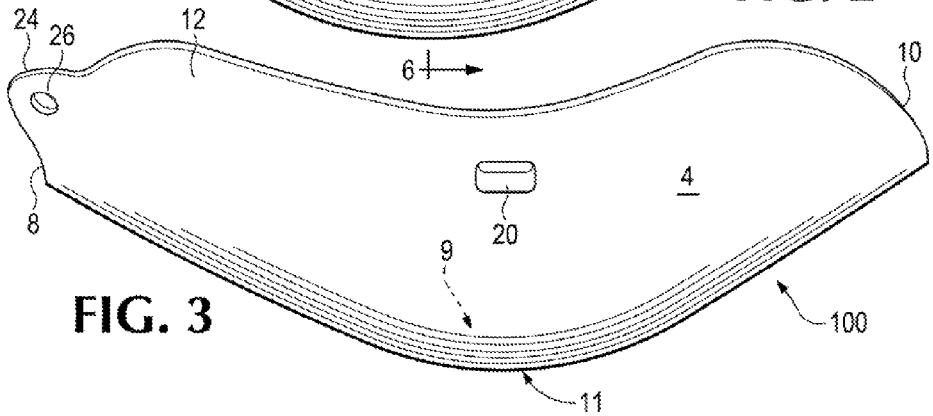
FIG. 3 is an opposing side elevation view relative to FIG. 2, depicting the collapsible bathing receptacle of FIG. 1.

The one or more perforations 18/20/22 can preferably all be formed at an approximately equal distance from the perimeter. However, because the invention can include alternative examples with a wide variety of peripheral shapes (e.g., higher sides than ends, one side higher than another, etc.), the perforations can alternatively be positioned irrespective to the periphery, but rather be disposed to provide a particular depth of water within the apparatus when positioned for use substantially as shown in FIGS. 2 and 3.

Additionally, plural perforations can be provided at different 'heights' along a sloped side or end of the apparatus. During use, lower holes can be selectively plugged with a correspondingly configured plug device to provide for a variable and user-selectable water depth. A resilient material such as the described EVA will provide a relatively watertight seal around a plug having an outer diameter slightly greater than and shaped correspondingly relative to an inner diameter and shape of a perforation.

In one or more examples, an 'ear' 24 portion extends outwardly from a periphery of one or the other bilateral half of the expanse. Typically, the ear 24 also includes a perforation 26 provided therethrough, which can be used to hang the apparatus on a hook or other suitable projection when not in use. When present, the ear 24 can be formed according to any of a large number of shapes, but will preferably be rounded as shown in the drawing figures to maintain a smooth outer periphery free of angles, corners, or other projections likely to catch on objects and potentially tear.

Uniquely, in at least one example, the first surface of the apparatus is more concavely curved at a central region 28 thereof than at an adjacent lateral region 30 lying outwardly toward the periphery of the apparatus relative to the central region. The more concave central region 28 is typically formed by the corresponding inner portions of the opposing right and left halves 12/14 of the apparatus, spanning and extending along a central line of the apparatus corresponding to the linear hinge 6.

Figure 6:
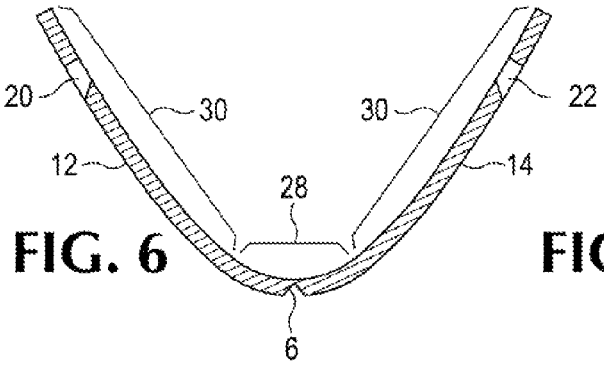
FIG. 6 depicts a transverse sectional view taken through the line 6-6 as shown in FIG. 2.
Figure 7:
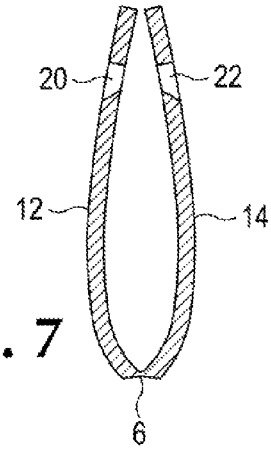
FIG. 7 depicts the transverse section view of FIG. 6 when the depicted collapsible bathing receptacle is bilaterally collapsed, as for storage.
Figure 8:
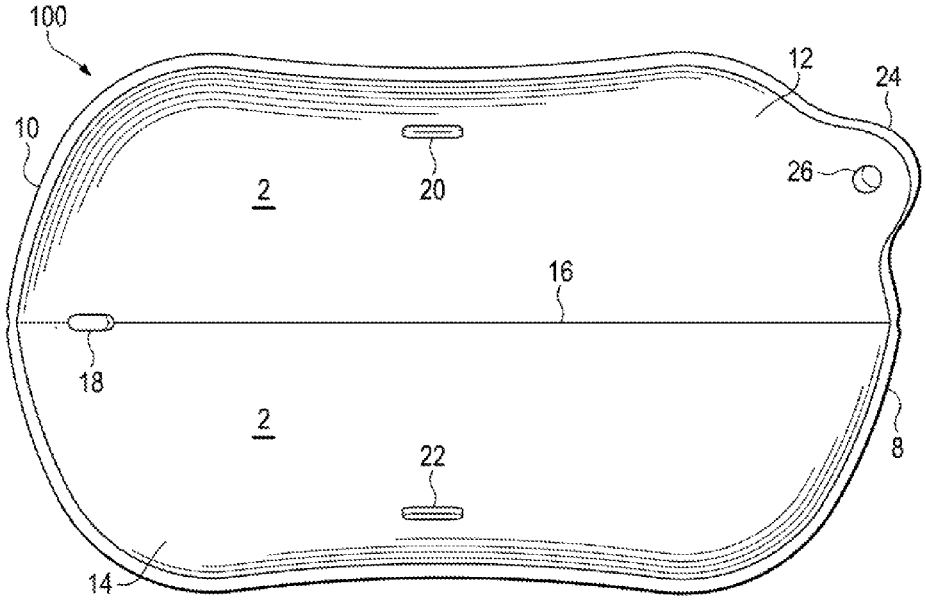
FIG. 8 is a top plan view of the collapsible bathing receptacle of FIG. 1.

As shown in FIG. 6, the central region forms a rounded surface for receiving and supporting an infant comfortably in position centrally within the apparatus, without pinching the infant's buttocks or back between sharply, upwardly angled sidewalls. When the apparatus is compressed and collapsed laterally, the more concave central portion remains somewhat rounded, as shown in FIG. 7, rather than collapsing to a substantially flattened configuration with the respective inner surfaces of the opposing right and left halves 12/14 arriving fully into contact with each other. However, at least one example of the invention does contemplate a configuration absent a more concave central region, such that the respective inner surfaces of the opposing right and left halves 12/14 can arrive fully into contact with each other when collapsed as in FIG. 7.

Alternative Examples

Although exemplary examples are discussed above with reference to the several drawing figures, the scope of the contemplated examples of the invention is not so limited. What follows is a non-exhaustive list and descriptions of additional examples and structural alternatives, provided to illustrate broader contemplated aspects of the invention.

One alternative example contemplates the hinge being a groove formed into the concave inner surface of the apparatus rather than into the outer convex surface as shown in the various drawing figures. An ordinarily skilled artisan will readily recognize that in such an example, the sidewalls of a groove will converge when the apparatus is laterally compressed, potentially contacting one another and presenting resistance to further lateral compression of the apparatus. Therefore, a grooved hinge disposed at the inner surface will preferably have sidewalls forming an angle of ninety degrees (90°) or greater when the apparatus assumes a relaxed, uncompressed condition.

Alternatively, a hinge in an example is formed of a linear row of perforations, generally two or more, extending through the expanse from the first surface to the second surface thereof, aligned between the left and right halves of the apparatus as in the manner of the above described groove. The perforations can each be either somewhat elongate or round, and can be either many or few in number, with a selection of number, size, and shape being determined in any particular example by simple experimentation performed in light of this description. A primary consideration in any particular example is an ability to collapse (e.g., fold) each of the respective left and right halves of the apparatus inwardly toward one another along the central hinge—as shown in FIGS. 6 and 7—in response to a bilaterally applied compressive load.

Of course, in examples where a hinge includes or is formed entirely of perforations extending through the expanse, the apparatus may not retain water, or a level of retained water may be lower than in an example having a grooved hinge. The apparatus will nevertheless provide many if not most of the intended benefits, and may provide additional benefits (e.g., lower cost, lighter weight, etc.).

While examples of the apparatus are described above as including an expanse of a polymeric foam material, alternative materials and compositions are also contemplated herein. According to one such alternative, the expanse is instead formed in part or in full of a plastic material (e.g., thermoplastic or thermosetting, etc.), molded or otherwise formed into the configuration generally shown in the several drawing figures. The plastic material does not include a closed cell structure in at least one example, but does in another. An exemplary but not exclusive list of suitable plastic materials includes polyethylene, polyurethanes (e.g., polyurethane foam), polypropylene, polyvinyl chloride, acrylonitrile butadiene styrene (ABS), nylon or others that would be recognized by an ordinarily skilled artisan. Generally, however, preferred examples will avoid the use of materials that may have or are known or suspected to adversely affect human health or development, including phthalates, bis(2-ethylhexyl) adipate ('BPA'), certain volatile organic compounds, and others as would be known to an ordinarily skilled artisan.

In such examples including an expanse formed of a plastic material, additional variations include over-molding or co-injection ('sandwich') molding the plastic with a softer material, such as a polymeric foam, a rubber material, or a similarly resilient, pliable material (e.g., silicone rubber, polyacrylic rubber, ethylene propylene rubber, fluorosilicone rubber, neoprene, fluoroelastomers, perfluoroelastomers, EVA, etc.). As used herein, "softer" means that the material of the pads compresses to a greater degree than does the plastic material in response to an equivalent load (e.g., amount of applied force). For example, a 'softer' material will generally have a lower measured durometer value than the material of the expanse with which the pads are used. An ordinarily skilled artisan will recognize a similar coupling of soft, grippable pads and a harder plastic material by a sandwich molding process in the example of many currently available toothbrushes with soft molded grips. In another example, the expanse may be formed of a single-layer plastic material. Forming the expanse from a plastic material may serve the purpose of providing for easier cleaning of the bathing receptacle, for example.

Furthermore, concerning the resilient plastic material of which the bathing receptacle may be composed, it should be noted that the material properties of such resilient plastic material include resiliency and pliability. These properties should be distinguished from the material property of rigidity. Resiliency and pliability have obvious advantages over rigidity as the material properties of a bathing receptacle, such as ease and simplicity of handling by the user. In addition, the resilient material tends to give the bathing receptacle a self-supporting form without the need to external framing, supports, ties, drawstrings, interlocking flaps, material tabs or the like. The resilient material supports an infant comfortably, since there is some give to the material, and there is sufficient rigidity so that the bathing receptacle holds its form and holds water. Because the material is springy or resilient after use, the user is able to push or fold the opposing surfaces together so that the unit folds to a somewhat flat unit for easy storage.

The resilient material is not fabric, which is incapable of holding its own shape without the addition of a supporting structure such as tabs drawstrings, stitching, or other mechanisms to pull the fabric into a desired shape. Also, material such as fabric is not inherently cushioning or resilient alone. Typically to provide cushioning, fabric is formed into a bag structure into which batting or stuffing may be inserted or filled. Sometimes stitching may be employed to hold the batting or stuffing in place. The resilient material used in the examples described herein makes no such use of stuffing, or other such fillings in order to provide a cushioned surface.

Alternatively, rather than applying a softer material to the plastic by molding, either of pads or sheets of a polymeric foam or similarly soft material, as above, can be laminated onto a surface of the plastic expanse by use of an adhesive disposed therebetween, or another method as will be recognized by an ordinarily skilled artisan.

Such adhesive will typically be a permanent adhesive formulated with water-resistant properties to prevent the laminated portion(s) from detaching from the expanse during normal use. Alternatively, the adhesive can be a reusable contact adhesive, which enables repeated manual attachment and detachment of the softer pads or sheets from the expanse, for ease of cleaning, drying, storage, or some other beneficial purpose.

In general, a pad formed of a softer material, as described above, will be disposed at least upon the inner surface of the apparatus, for the comfort and safety of an infant disposed therein during use of the apparatus. However, all or some portion(s) of the outer surface of a plastic expanse can also include a covering of a polymeric foam to enhance insulative properties of the apparatus, for example, or to provide improved friction between the apparatus and a surface of a basin within which the apparatus is disposed during use.

In still another example, pads or sheets of a softer material, as discussed above, can be affixed to a plastic (or other semi-rigid) expanse by inserting one or more resilient, plug-like portions of such pad or sheet through corresponding perforations provided through the expanse. Such plug-like portions, or 'tabs' for descriptive convenience herein, can be provide at either or both of a back surface of a pad (e.g., as will confront a surface of the expanse when disposed for use) or along one or more edges of a pad. A tab will generally have a narrow 'neck' portion extending from the body of the pad and terminating with a wider distal portion. Therefore, when inserted into and through a perforation provided through the expanse, the wider distal portion prevents the tab from spontaneously backing out from the perforation, while nevertheless allowing a user to manually detach the pad without damage to either the pad or the expanse.

The pad or sheet will generally have a back side that faces and conforms substantially to the surface of the expanse. An opposing front surface of the pad or sheet, orientated to confront a user's (e.g., an infant's) body, can have nearly any peripheral shape (e.g., circular, squared, kidney-shaped, etc.), whether symmetrical or asymmetrical, and nearly any size, and will generally present a softer, more comfortable surface to the user's skin. The upper, user-facing side of such pads or sheets will generally, but not exclusively, either be rounded like a dome, or relatively flattened but with rounded edges at a periphery thereof, therefore avoiding sharp corners or edges from confronting a user. Typically, the peripheral edges of all such detachable pads or sheets are confined within the outer periphery of the expanse. However, in at least one example, a peripheral edge of one or more such pads, when attached to the expanse during use, extends beyond a peripheral edge of the expanse in at least one direction, providing a cushioned barrier between a user and an edge of the expanse.

Such pads can be disposed at a surface of the expanse in any number or configuration, including but not limited to one or more rows of plural pads disposed along and on each side of the central hinge, one or more pads disposed along and within a periphery of the expanse to form an additional boundary cradling a user within the bath during use, or as one or more bands extending transversely across the central hinge to 'suspend' one or more portions of the user thereabove. For example, a band can be provided at the head end to support an infant's head or neck, or can be provided proximate the foot end of the expanse to underlie and elevate an infant's knees and to discourage dislocation of the infant toward the foot end in case the apparatus is inadvertently tipped in that direction during use. Of course, nearly any corresponding arrangement of perforations are contemplated as being disposed through the expanse to enable attachment of detachable pads or sheets in a multitude of arrangements.

In another alternative example, the respective bilateral halves of the expanse could be formed of a more rigid or semi-rigid material such as laminated or steam-bent wood or bamboo. Although more rigid than a polymeric foam material, for example, such laminated or steam-bent materials nevertheless can be flexed somewhat in response to an applied load (as the limbs of a bow used in archery), and therefore can also be considered somewhat resilient within the scope and intent of the invention.

Such materials can be formed as curved shapes, such as the apparatus shown in the drawing figures, and a pliable hinge can be provide between and coupled with each of the halves of the apparatus to enable the halves to collapse laterally and fold together as described above. The suitable hinge can be formed of a pliable material, such as a polymer or a textile, or can be one or more interacting, multi-piece hinge structures, such as interlocking eyescrews. Alternatively, the respective bilateral halves can be hinged at or near the floor of the apparatus, and when compressed bilaterally, the head and foot ends of one of the bilateral halves may slide along and overlap the corresponding head and foot ends of the other bilateral half, allowing the apparatus to collapse bilaterally in a substantially similar manner as is shown in FIGS. 6 and 7.

In an example, the periphery of the apparatus can be provided with a rolled or angled lip. A lip can be provided at the head end, at the foot end, at either of the bilateral halves, or at any combination thereof. The lip can be formed of the same material as the expense, and can be of the same relatively uniform thickness as the expanse or can alternatively be either thinner or thicker than the expanse. The lip can be configured simply as a thickening of the material of the expanse, such as the thickened rim discussed above, or can be formed to extend outwardly at an angle relative to the outer surface of the expanse in a manner similar to the lip on a common bathroom sink (e.g., washbasin). In addition to providing additional structural stability to the apparatus, a peripheral lip structure can also help retain the apparatus in position within a washbasin during use.

In an example, rather than the bilateral halves of the apparatus flexing along a single central hinge, two such hinges are provided, one on either side of a central region positioned within the apparatus as discussed above. The two hinges can converge with one another at each of the opposing head and foot ends of the apparatus, or in another example, can remain separated from one another, whether provided in parallel or along reciprocally curving paths.

Each of the bilateral 'halves' of the apparatus flexes inwardly along one of the two hinges, while the central region remains stationary. Therefore, when viewed in the same cross-sectional view as FIG. 7, such example would resemble nearly a triangle with a relatively narrow base. As will be recognized, the bilateral 'halves' in such example do not each represent an actual fractional half of the apparatus, but rather each represents approximately half of the area of the expanse comprising the collapsible portions of the apparatus, excluding a relative narrow central portion disposed therebetween. The actual fractional proportion of each such 'half' or collapsible 'wing' of the apparatus could be two-fifths (2/5), three sevenths (3/7), four-ninths (4/9) or some other proportion of the expanse that accommodates a relatively narrow central region lying between the opposing bilateral portions of the apparatus.

The invented examples also contemplate one or more accessory hinges being provided, each extending along a curvilinear path disposed between a main 'central' hinge described above and a peripheral edge of one of the bilateral halves of the apparatus. Accessory hinges will typically be provided as corresponding pairs, with one disposed on each side of the main central hinge. A first end of each such accessory hinge will originate at or near the head end of the apparatus, while an opposing second end will extend to a point at or near the foot end of the apparatus.

At least one contemplated example reverses the configuration such that the apparatus assumes a bilaterally collapsed condition when relaxed, but assumes an open, bowl-like configuration when the opposing bilateral halves of the apparatus are forced apart from one another, as when deployed for use. An ordinarily skilled artisan will recognize that nearly all features of the apparatus described according to the several examples could likewise be present in this collapsed-when-relaxed example, the main difference being an open versus collapsed condition of the apparatus 'as-molded' or otherwise first formed.

In yet another example, the expanse includes a central hinge extending longitudinally between the head end and foot end of the expanse, as described above, and also includes one or more additional 'lateral' hinges extending outwardly from the central hinge toward, or to, the periphery of a bilateral half of the expanse. In a particular example, two such lateral hinges, comprising a cooperative pair, extend outwardly in opposing directions from a common location along the central hinge. Therefore, in plain view, the lateral hinges and the central hinge define a relatively cruciform arrangement, although the angles between the hinges can be either right, obtuse, or acute, according to alternative examples.

A benefit of such arrangement is that the expanse can be additionally folded for storage, yielding a much smaller storage 'footprint' and consuming less space.

In a preferred example, two such pairs of lateral hinges extend outwardly from the central hinge at two separate locations along the central hinge. The two pairs of lateral hinges divide the expanse into three sections; each of a head end section and an foot end section each comprising approximately a fourth of the length of the expanse, and a middle section comprising approximately the middle one half of the length of the expanse.

For storage, the foot end of the expanse can be collapsed either inwardly or outwardly toward the head end, flexing along the foot end lateral hinges. The head end can be likewise collapsed inwardly or outwardly toward the foot end of the expanse, flexing along the head end lateral hinges. When flexed in this manner, the periphery of the head end will approach, touch, or overlap the periphery of the foot end at a position corresponding to the central hinge. Additionally, the bilateral halves of the expanse can then be collapsed inwardly toward one another by flexing the central hinge.

As will be easily recognized in light of this description, if the respective head end and foot end have both been flexed inwardly, they will both be confined between the confronting inner surfaces of the collapsed opposing bilateral halves, providing the expanse with a substantially reduced storage footprint. The width, depth, and side of the expanse into which the hinges are formed will be selected to facilitate compact folding of the expanse, with consideration to such factors as compression of the material of the expanse due to folding and other factors as would be readily apparent to an ordinarily skilled artisan in view of this description.

It will be understood to an ordinarily skilled artisan that the present invention is not limited to the specific details of construction, fabrication, material, application or use described and illustrated herein. Indeed, any suitable variation of fabrication, use, or application is contemplated as an alternative example, and thus is within the spirit and scope, of the invention. Such alternative examples of the present invention may result from changes in application or method of use or operation, configuration, method of manufacture, shape, size, or material.

Accordingly, while the present invention has been shown and described with reference to the foregoing examples of the invented apparatus, it will be apparent to those skilled in the art that other changes in form and detail may be made therein without departing from the spirit and scope of the invention as defined in the appended claims.

The invention claimed is:

1. A bilaterally collapsible bathing receptacle, comprising:

a contiguous expanse of a resilient plastic material having a first concavely curved surface and an opposing convexly curved surface; and a first hinge extending from a first end to an opposing second end of the expanse, wherein:

the first hinge longitudinally bisects the expanse and defines opposing longitudinal bilateral halves thereof, and the expanse is configured to assume an open, bowl-like configuration in a relaxed state without utilizing additional clips or fasteners to maintain its bowl like configuration, and when inwardly compressed laterally, flexes along the first hinge and places the respective first surfaces of the opposing bilateral halves into confrontation with one another by the lateral flexing of the hinge allowing one of the opposing bilateral halves to flex changing its direction of concavity, and without the need for fastening devices to maintain the opposing bilateral halves in confrontation with each other.

2. The bathing receptacle of claim 1, wherein the expanse possesses a generally uniform thickness throughout excepting the first hinge.

3. The bathing receptacle of claim 1, wherein the first surface of the expanse is less concavely curved at a central region aligned with the first hinge than at a lateral region lying outwardly relative to the central region.

4. The bathing receptacle of claim 1, wherein the expanse is elongate from the first end to the second end.

5. The bathing receptacle of claim 1, further comprising: one or more perforations formed though the expanse from the first surface to the second surface proximate a periphery of the expanse.

6. The bathing receptacle of claim 1, further comprising: an ear extending outwardly from one or the other bilateral half of the expanse, the ear including a perforation extending therethrough.

7. The bathing receptacle of claim 1, wherein the expanse comprises a closed-cell polymeric material.

8. The bathing receptacle of claim 1, wherein the first hinge comprises a linear groove disposed at the second convex surface and extending through a portion of a thickness of the expanse.

9. The bathing receptacle of claim 1, wherein the first hinge comprises a linear arrangement of two or more perforations disposed between the opposing bilateral halves of the expanse and extending through the expanse from the first surface to the second surface thereof.

10. The bathing receptacle of claim 1, wherein the resilient material of the expanse comprises either or both of a thermoplastic material and a thermosetting plastic material.

11. The bathing receptacle of claim 1, wherein the resilient material of the expanse comprises either or both of laminated wood and bamboo.

* * * * *